United States Patent [19]

Allen et al.

[11] Patent Number: 5,007,606

[45] Date of Patent: Apr. 16, 1991

[54] SUPPORT STAND FOR FOOD POUCHES

[76] Inventors: Ronald R. Allen, 211 N. Victoria; William D. McEwen, 727 Viewcrest Dr., both of Ventura, Calif. 93003

[21] Appl. No.: 468,611

[22] Filed: Jan. 23, 1990

[51] Int. Cl.[5] ..... A47G 23/02

[52] U.S. Cl. ..... 248/152; 211/13; 248/174

[58] Field of Search ..... 248/174, 152, 97, 150, 248/146; 211/13, 72, 70.1, 200, 60.1; 141/316; D7/76

[56] References Cited

U.S. PATENT DOCUMENTS

| | | | |
|---|---|---|---|
| D. 262,764 | 1/1982 | Meyer . | |
| D. 283,333 | 4/1986 | Cavanagh . | |
| 329,150 | 10/1885 | Eaton | 211/200 |
| 598,028 | 1/1898 | Smith | 248/174 |
| 3,102,721 | 9/1963 | Linville | 248/164 X |
| 3,443,781 | 5/1969 | Wysowski | 248/164 |
| 4,102,488 | 7/1978 | Morrow et al. . | |
| 4,248,278 | 2/1981 | Blodgett . | |
| 4,358,958 | 11/1982 | Wehrenberg . | |
| 4,589,619 | 5/1986 | Forbes | D7/76 X |
| 4,653,645 | 3/1987 | Thomas | 211/13 |
| 4,796,314 | 1/1989 | Garduno | 248/164 |

FOREIGN PATENT DOCUMENTS

| | | | |
|---|---|---|---|
| 1098163 | 7/1955 | France | 248/164 |

*Primary Examiner*—J. Franklin Foss

*Attorney, Agent, or Firm*—Kelly Bauersfeld & Lowry

[57] ABSTRACT

A compact and lightweight support stand is provided for use by campers, backpackers, etc., to support a food pouch or the like containing dehydrated food adapted for reconstitution upon addition of water. The support stand comprises a pair of substantially identical plates shaped to interlock in facing relation to define a stable trough for receiving and supporting a food pouch in an open condition during rehydration and serving. The plates are adapted to be disassembled and nested compactly, such that the support stand occupies a minimum space when packed with other camping equipment.

6 Claims, 2 Drawing Sheets

SUPPORT STAND FOR FOOD POUCHES

BACKGROUND OF THE INVENTION

This invention relates generally to equipment items for use by campers and backpackers and the like, particularly with respect to equipment items for use in the preparation and serving of food. More specifically, this invention relates to a relatively simple and easy-to-use support stand for receiving and supporting a food-containing pouch in a secure and stable manner.

Camping and related outdoor activities such as backpacking and hiking into remote or wilderness areas have achieved widespread popularity in recent years. In such activities, a variety of equipment items are normally used such as sleeping bags, tents, cooking apparatus and related utensils and food items, etc. In general, these equipment items are designed to be lightweight and compact in size to permit packing with minimum space requirements, and thereby facilitate transport to a selected campsite.

Dried or dehydrated food products are often used by campers and backpackers since such products are both compact and relatively lightweight in nature, and are often available with a minimum of packaging material requiring proper disposal. In this regard, recent advances in food technology have made available a wide range of food items in freeze dried or dehydrated form ready for rehydration and eating at a campsite. Such food products are packaged within a lightweight foil-based bag or pouch which can be packed and easily carried with other equipment items. At a selected time and place, the food pouch is opened and the contents thereof are rehydrated by adding water, typically hot water, directly into the food pouch and allowing the mixture to stand for several minutes. The thus-prepared food item may be eaten directly from the pouch or served with the use of appropriate utensils, all in a manner which avoids the need for traditional cooking vessels and minimizes or eliminates post-meal related clean-up procedures. When empty, the food pouch may be discarded into a proper waste container or otherwise carried with other camping equipment until a waste container is located.

Although the availability of dehydrated food products has greatly expanded the type and quality of food products which can be easily carried by campers and backpackers, the food pouches containing such products are often somewhat difficult to manipulate without spillage. For example, the flexible food pouch possesses relatively little structural stiffness, such that the pouch is inherently unstable especially when opened and filled with water to rehydrate the food product therein. Such instability is compounded by the use of hot water to rehydrate the food product, since hot water typically renders the pouch difficult to hold or handle manually. As a result, the water-filled pouch is normally rested with minimal stability in a position leaned against any available support structure such as a rock or a tree during the rehydration period, with food spillage occurring with undesired frequency.

There exists, therefore, a significant need for a relatively simple device for use by campers and the like to receive and support a water-filled food pouch in a secure and stable manner, particularly wherein such device is lightweight and adapted for packing with minimal space requirements with other items of camping equipment. The present invention fulfills these needs and provides further related advantages.

SUMMARY OF THE INVENTION

In accordance with this invention, a support stand is provided for use by campers, backpackers, etc., to receive and support a food pouch of the type containing dried or dehydrated food. The support stand is constructed from lightweight components and can be assembled or deployed quickly and easily to form a relatively deep elongated trough for receiving a flexible food pouch in a secure and stable manner. The support stand is further adapted to collapse to a highly compact profile for facilitated packing in a minimum volume with other items of camping equipment.

In a preferred form of the invention, the support stand comprises a pair of substantially identical plates shaped for assembly in facing relation to define the pouch-receiving trough, and to nest when disassembled in a highly compact profile. More particularly, each of the plates includes a generally upright side wall joined along a lower margin thereof to a base wall extending therefrom at an angle of about forty five degrees. If desired, the lower margin of the base wall may be joined in turn to a foot which extends generally perpendicular to the associated side wall. Importantly, these plates are adapted when disassembled to nest compactly, one within the other, to occupy a relatively minimal space and volume for facilitated packing with other camping equipment.

The base wall of each plate includes at least one narrow slot extending generally horizontally from one end edge to approximately a midpoint thereof. With this configuration, the two plates can be assembled and interlocked by orienting the plates in facing relation and slidably receiving the base wall of each plate into the slot formed in the base wall of the other plate. When interlocked in this manner, the base walls of the two plates define a stable support structure of X-shaped geometry, and defining a generally V-shaped lower base for a trough which extends upwardly between the plate side walls. The width of this trough is chosen according to the distances of the interlocking slots below the plate side walls, with one form of the invention including multiple slots in the base walls to provide a selection of trough widths. In any case, the trough has sufficient depth to receive and support a food pouch in a secure and stable manner.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
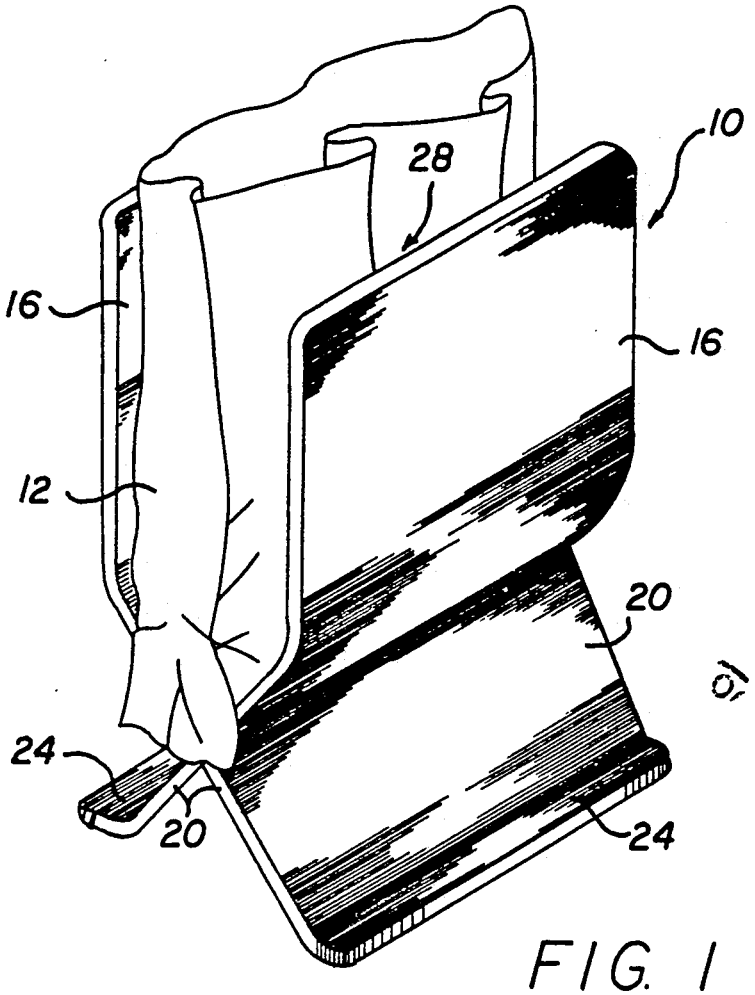
FIG. 1 a perspective view of a support stand embodying the novel features of the invention and shown supporting a food pouch containing a selected food item.

As shown in the exemplary drawings, a lightweight support stand referred to generally in FIG. 1 by the reference numeral 10 is provided for use in supporting an open food pouch 12 of the type commonly used by campers and backpackers. The support stand 10 provides a secure and stable structure for supporting the food pouch 12 throughout food preparation and serving procedures. When not in use, the support stand is quickly and easily disassembled and arranged in a compact configuration adapted to occupy minimum space requirements when packed with other camping equipment.

The support stand 10 of the present invention is particularly designed for use with flexible bag-type packets or pouches containing dried or dehydrated food products. Such food pouches provide extremely compact and lightweight storage containers for many different types of food products in individualized or multiple servings, wherein the pouches are easily packed and transported with other camping equipment to a remote area campsite or the like. At mealtime, the food product within a pouch can be reconstituted or rehydrated for consumption by simple addition of typically heated water. Exemplary food pouches or packets of this general type are marketed by Richmoor Corporation, Van Nuys, Calif., under the mark Richmoor.

The food pouch 12 is normally constructed from a lightweight plastic and/or foil lined material for prolonged stable storage of a selected food product. Moreover, the pouch material is water impervious to permit water to be added directly into the pouch, thereby avoiding the need for traditional food preparation utensils such as a cooking pot and the post-meal clean-up chores associated therewith. The support stand 10 of the present invention provides a safe and secure base structure for supporting the food pouch 12 throughout food preparation and serving procedures.

Figure 2:
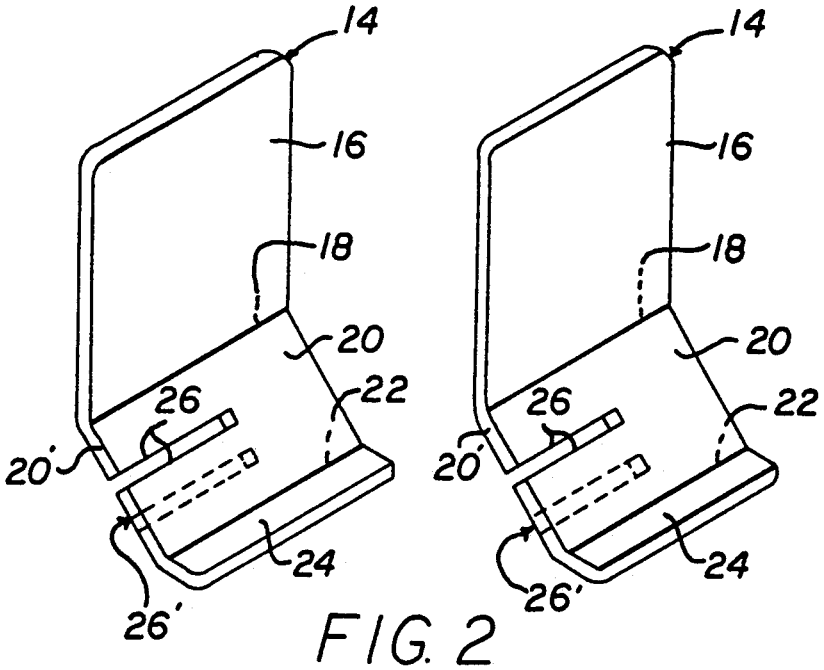
FIG. 2 is an exploded perspective view illustrating a pair of substantially identical plates for use in forming the support stand of FIG. 1.
Figure 3:
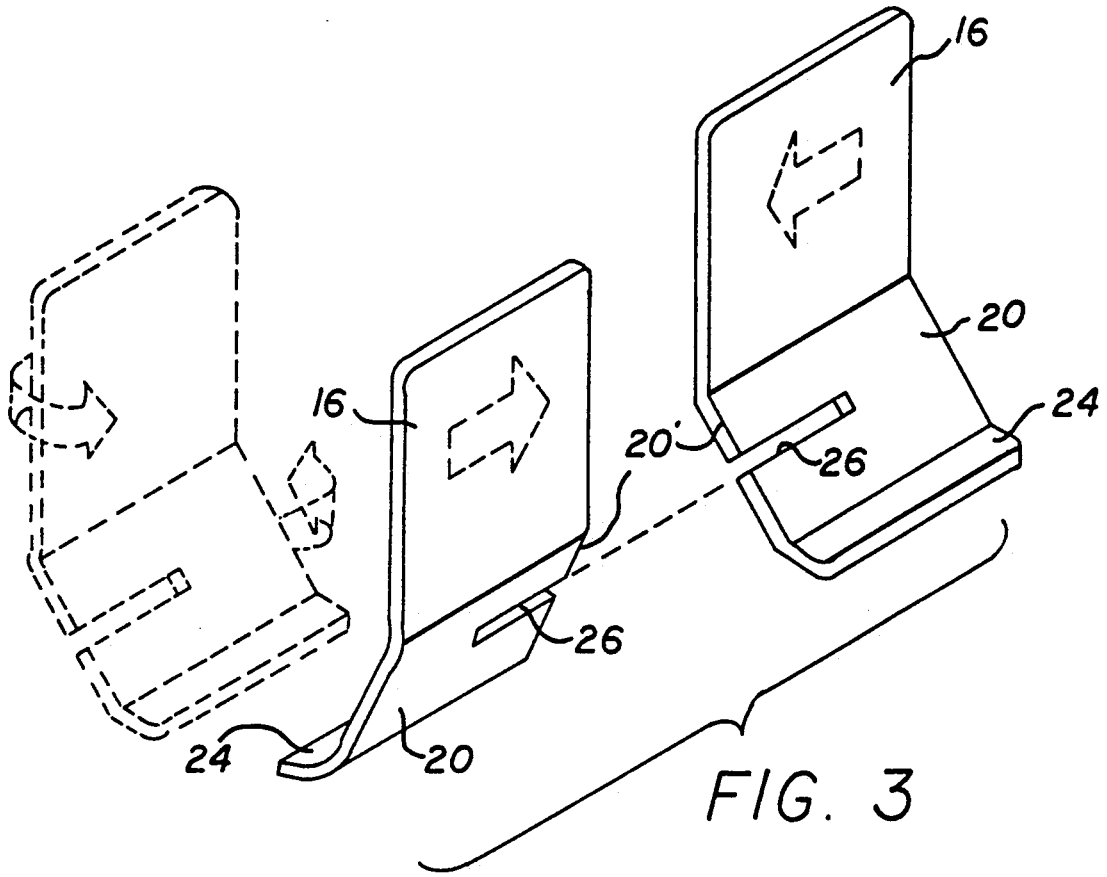
FIG. 3 is an another exploded perspective view showing assembly of the pair of plates in face-to-face relation to form the support stand.

As shown best in FIGS. 2 and 3, the support stand 10 is formed from a pair of plates 14 which, in the preferred form, are identical to each other. These plates 14 are constructed from a suitable lightweight and relatively economical material particularly such as molded plastic, although alternative plate materials such as stamped metal sheet or the like may be used. In one preferred form, the plates 14 may be constructed from a luminescent plastic or the like to provide high visibility in the typically low light level environment of a remote campsite. In any case, these plates 14 are adapted to interlock in facing relation (FIGS. 1 and 3) to provide a stable support structure for a food pouch 12 or the like, or to be disassembled and nested compactly one within the other (FIG. 4) for compact packing with other items of camping equipment.

Figure 4:
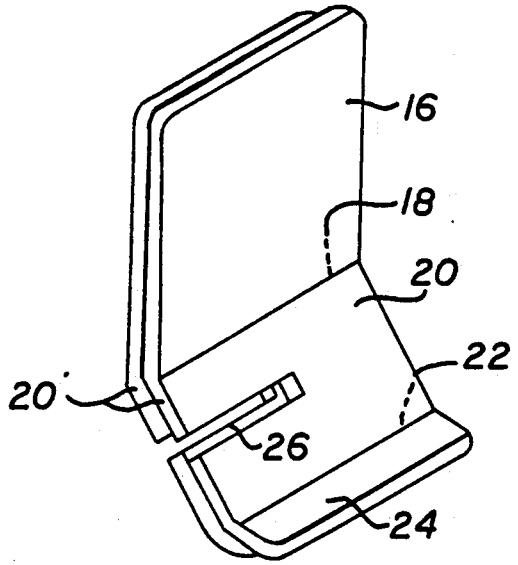
FIG. 4 is a perspective view of the plates in nested relation for facilitated packing and compact transport.

Each of the support stand plates 14 includes an upper side wall 16 of generally rectangular shape (FIGS. 2–4). A lower margin of this side wall 16 is joined integrally at a bend line 18 to an angularly turned base wall 20 which also has a generally rectangular shape. In the preferred form, the base wall 20 is oriented at an angle of about forty five degrees to the plane of the side wall 16, and is joined integrally at a lower bend line 22 with a short foot 24. The foot 24 is set angularly at about forty five degrees to the base wall 20 and is further oriented substantially at a right angle to the side wall 16.

The base wall 20 of each plate 14 further defines a leading end edge 20' having an elongated narrow locking slot 26 formed therein. This locking slot 26 extends generally horizontally relative to the base wall 20, in substantially parallel relation to the bend lines 18 and 22, to approximately the midpoint between the opposite end edges of the base wall. Moreover, as will become more apparent, the slot 26 has a width sufficient for relatively close sliding reception of the base wall 20 of the opposite plate 14.

As shown in FIG. 3, the two plates 14 can be quickly and easily assembled in interlocked relation to form the support stand 10. More particularly, the plates 14 are oriented in facing relation with the leading end edges 20' of their associated base walls 20 faced toward each other. By aligning the locking slots 26 of the two plates, the two base walls 20 can be slidably seated respectively into the locking slots 26 of the opposite plate, resulting in interconnection of the base walls 20 in a stable X-shaped end profile with the base walls 20 crossing substantially at right angles as viewed in FIG. 1. In this configuration, the portions of the base walls 20 disposed below the slots 26 extend downwardly and outwardly in an inverted V-shaped geometry for cooperation with the outwardly projecting feet 24 to provide a stable support base. The portions of the base walls 20 disposed above the slots 26 extend upwardly and outwardly in a V-shaped profile to the side walls 16 which protrude upwardly in parallel spaced relation to each other. These upper regions of the base walls 20 thus cooperate with the side walls 16 to define an elongated and relatively deep trough 28 (FIG. 1) for receiving and supporting the food pouch 12. Importantly, the structure is capable of supporting the pouch 12 in a secure and stable manner notwithstanding the lightweight flexible structure of the pouch and the addition of water into the pouch for rehydration of the food product therein.

The plates 14 of the support stand 10 are similarly disassembled quickly and easily by separating the plates. When disassembled, the two plates can be nested one upon the other as viewed in FIG. 4 to assume an extremely compact configuration. In this state, the two plates 14 are easily and compactly packed as a substantially flat item along with other camping equipment, such as sleeping bags and the like. When subsequent use is desired, the plates 14 are easily re-assembled to form the support stand 10, as previously described.

A variety of modifications and improvements to the support stand 10 of the present invention will be apparent to those skilled in the art. For example, as viewed in dotted lines in FIG. 2, one or more additional locking slots 26' can be formed in the base wall 20 of each plate 14 to provide alternative positions for interlocking assembly of the two plates. This provision of multiple locking slots beneficially permits the width of the trough 28 to be selected according to the size and shape of the food pouch 12 to be supported. Accordingly, no limitation on the invention is intended by way of the foregoing description and accompanying drawings, except as set forth in the appended claims.

What is claimed is:

1. A support stand for receiving and supporting a flexible pouch of the type used for containing dehydrated food or the like, said support stand comprising:

first and second substantially identical plate members each defining an upright side wall, and a generally rectangular base wall joined to said side wall along a bend line at a lower edge thereof and extending generally angularly with respect to said side wall;

each of said base walls defining a leading edge and trailing edge extending downwardly and outwardly from said bend line, each of said base walls further defining and elongated slot opening at the leading edge thereof and extending generally in parallel with said bend line approximately to a midpoint between the leading and trailing edges thereof;

said plate members being releasably and slidably interlocked by orienting said plate members with the leading edges of their respective base walls in facing relation and slidably fitting said base wall of each plate member into the slot formed in the base wall of the other plate member, thereby interconnecting said plate members with said base walls interlocked in a generally X-shaped profile and with said side walls projecting upwardly from said base walls in spaced and generally parallel relation to define a substantially horizontally oriented pouch-receiving trough, said plate members being slidably separable and nested one upon the other to pack in a substantially minimum profile geometry.

2. The support stand of claim 1 wherein said plate members are identical.

3. The support stand of claim 1 wherein said side wall and said base wall of each of said plate members ar integrally formed.

4. The support stand of claim 1 wherein said side wall and said base wall of each of said plate members are generally planar, said base wall extending angularly from said side wall at an angle of about forty-five degrees.

5. The support stand of claim 4 wherein each of said plate members further includes a support foot joined to said base wall along a side edge thereof opposite the associated side wall, said support foot being disposed generally perpendicularly to the associated side wall and at an angle of about forty five degrees to the associated base wall.

6. The support stand of claim 1 wherein each of said plate members includes a plurality of said slots formed in the base wall thereof.

* * * * *